United States Patent [19]

Weber

[11] 4,420,957

[45] Dec. 20, 1983

[54] MONITOR METHOD AND APPARATUS FOR PARTICLE BLASTING EQUIPMENT

[75] Inventor: Joseph H. Weber, Grand Rapids, Mich.

[73] Assignee: Progressive Blasting Systems, Inc., Grand Rapids, Mich.

[21] Appl. No.: 314,792

[22] Filed: Oct. 26, 1981

[51] Int. Cl.[3] ..... B21J 00/00

[52] U.S. Cl. ..... 72/1; 72/53; 72/40; 29/90 A; 51/410; 51/438; 73/861.76

[58] Field of Search ..... 72/1, 40, 53; 29/90 A; 51/410, 417, 419, 427, 438; 73/861.76

[56] References Cited

U.S. PATENT DOCUMENTS 3,138,845 6/1964 Hellmann et al. ..... 72/53

3,282,102 11/1966 Rosaen ..... 73/861.75

4,041,891 8/1983 Rosaen ..... 73/861.75

*Primary Examiner*—Francis S. Husar

*Assistant Examiner*—David B. Jones

*Attorney, Agent, or Firm*—Price, Heneveld, Huizenga & Cooper

[57] ABSTRACT

An improved particle blasting apparatus for continuously monitoring media flow, nozzle wear, and nozzle blockage. The apparatus includes a source of compressed air, a nozzle, structure for conveying the compressed air from the source to the nozzle in an airstream, structure for introducing the media into the airstream to be carried by the airstream, and an air flow rate meter in the air conveying structure to indicate the air flow rate therein. In a preferred embodiment, indicator lights are included which are illuminated if the air flow rate falls outside of an acceptable range. A method of using the particle blasting apparatus is also disclosed.

24 Claims, 3 Drawing Figures

MONITOR METHOD AND APPARATUS FOR PARTICLE BLASTING EQUIPMENT

BACKGROUND OF THE INVENTION

The present invention relates to particle blasting equipment and methods, and more particularly to particle blasting equipment and methods for monitoring media flow, nozzle wear, and nozzle blockage.

Particle blasting equipment is used in a variety of applications for a variety of purposes. In particular, such equipment is used to compressively peen metal parts to improve fatigue and stress characteristics of the parts. Particle blasting equipment is also used to blast objects to remove surface irregularities, dirt and the like.

Typically, particle blasting equipment includes a source of compressed air, structure for conveying the compressed air from the source, structure for introducing the particle blasting media into the airstream, and a nozzle for directing the airstream, carrying the blasting media, against a desired article. One problem that has plagued the industry is that often either excessive or insufficient media is directed onto the articles being blasted, resulting in improper blasting of the articles.

A particle blasting nozzle typically includes a restricted opening to focus or direct the media passing therethrough. As the blasting media passes through the nozzle, the restricted opening is worn away and enlarged. Ultimately, the opening is so enlarged that the media stream is not properly focused. Consequently, nozzle wear must be monitored to determine the appropriate time to replace the worn nozzle with one having a properly dimensioned opening.

The nozzle may also become blocked due to excessive media accumulation within the nozzle. When such blockage occurs, blasting is interrupted until appropriate corrective action is taken. Accordingly, the nozzle must also be monitored for blockage as well as excessive wear.

Media flow in prior blasting equipment is monitored by either viewing the media discharged from the nozzle or observing the amount of media expanded during a given time. However, a visual observation of the media passing out of the nozzle does not provide an accurate measurement of the media flow. Monitoring the media expanded over a given quantum of time provides only an average media flow and does not indicate periods of shorter duration when the media flow falls above or below acceptable levels.

Typically, nozzle wear in prior equipment is inspected only after the airstream is interrupted. The restricted opening is examined either visually or using a measuring gauge. Such an examination is time consuming, requiring equipment shutdown, and must be performed repeatedly. Nozzle monitoring problems are further complicated when the nozzle is located within a shroud or other protective equipment.

SUMMARY OF THE INVENTION

The aforementioned problems are solved by the present invention. Essentially, a particle blasting apparatus is provided having a source of compressed air, a nozzle having a restricted opening, structure for conveying the compressed air from the source to the nozzle in an airstream, structure for introducing particle blasting media into the airstream, and structure responsive to the rate of flow of the airstream through the air conveying structure. I have conceived that because the rate of flow of the airstream is affected primarily (1) by the amount of media accelerated and carried by the stream and (2) by the effective size of the restricted opening in the nozzle, media flow, nozzle wear, and nozzle blockage can be monitored by monitoring the air flow rate. If the air flow rate exceeds a predetermined maximum parameter, either insufficient media is being introduced into the airstream or the restricted opening in the nozzle is excessively worn. On the other hand, if the air flow rate falls below a predetermined minimum parameter, either excessive media is being introduced into the airstream or the nozzle is blocked.

A blasting apparatus in accordance with the present invention provides for continuously, readily, and easily monitoring both the media flow rate and nozzle wear and blockage without interrupting the blasting operation. Further, because the monitoring is performed continuously, relatively brief periods of excessive or insufficient media flow are readily and easily detected.

In an alternative embodiment of the invention, the structure monitoring the rate of flow of the airstream is operably connected to indicator lights which are lit when the air flow rate exceeds a predetermined maximum parameter or falls below a predetermined minimum parameter. In another alternative embodiment of the invention, the air flow monitor structure is operably connected to shut-off valves to automatically shut the blasting equipment down if the air flow rate falls outside the range of acceptable parameters.

These and other objects, advantages, and features of the invention will be more fully understood and appreciated by reference to the written specification and appended drawings.

DESCRIPTION OF THE PREFERRED EMBODIMENT

Figure 1:
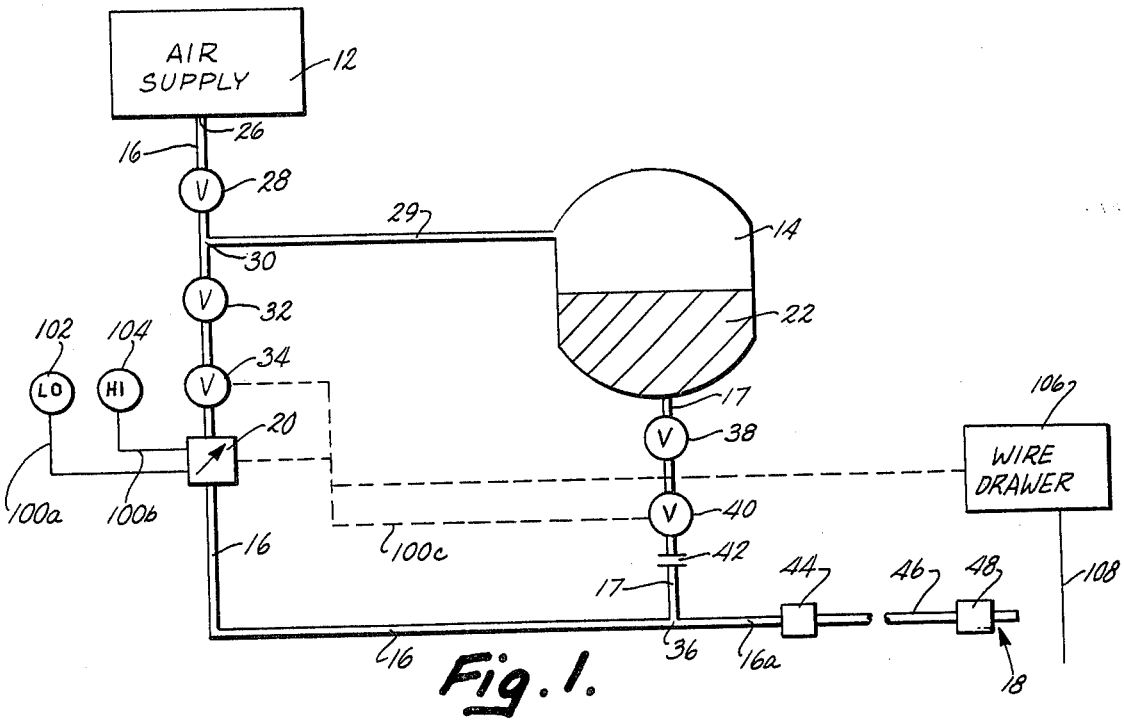
FIG. 1 is a schematic diagram of the particle blasting apparatus of the present invention.

A particle blasting device in accordance with a preferred embodiment of the invention is illustrated in the drawings and generally designated 10. As seen in FIG. 1, device 10 includes compressed air supply 12, media pot 14, nozzle 18, piping 16 interconnecting air supply 12 and nozzle 18, media pipe 17 interconnecting media pot 14 and piping 16, and air flow meter 20 positioned within piping 16. When device 10 is actuated, compressed air flows from supply 12 to nozzle 18 through piping 16. Media 22 within pot 14 is introduced into piping 16 through media tube 17. This mixture of compressed air and blasting media is then directed by nozzle 18 onto the article to be blasted, for example wire 108. Nozzle 18 (FIG. 2) defines a restricted opening 24 to focus or direct the blasting media passing therethrough. Because the compressed air enters piping 16 at a relatively constant pressure, the volume or rate of flow of air through piping 16 is affected primarily by the amount of media 22 introduced into the piping and the size of restricted opening 24 in nozzle 18. Consequently, the rate of flow of media 22 and the effective size of opening 24 are monitored by monitoring the air flow rate through meter 20 in piping 16.

Except for the inclusion of air flow meter 20, particle blasting device 10 is generally well known to those having ordinary skill in the art, and consequently, a detailed description of its structure and function is not necessary. Air supply 12 is a conventional supply producing an air pressure at port 26 of approximately 100 psi. Air flowing out of supply 12 passes through pressure regulator 28, which may be adjusted to further reduce and control the pressure of the air flowing through piping 16. In a preferred embodiment of the invention, valve 28 is adjusted so that air exiting valve 28 has a pressure of approximately 80 psi.

Media pressure pipe 29 extends from piping 16 at junction 30 and communicates with both piping 16 and media pot 14 to pressurize the pot. As will be described, media 22 will not generally flow through media tube 17 unless pot 14 is so pressurized.

After junction 30, air in piping 16 flows serially through shut-off valve 32 and control valve 34. Shut-off valve 32 is a diaphragm valve which enables the air flow in piping 16 to be shut off so that maintenance on elements downstream of valve 32 (e.g., control valve 34, flow meter 20, nozzle 18) can be performed. Control valve 34 is a pinch valve included to allow and restrict air flow through piping 16 as the particle blasting stream is to be started and stopped. Air leaving control valve 34 then passes through air flow meter 20 to mixing junction 36.

Media tank 14 is a closed, hollow member adapted to receive particle blasting media 22. Media pressure pipe 29 interconnects piping 16 and pot 14 to pressurize the pot allowing media 22 to flow downwardly through media tube 17. Media 22 exits pot 14 by a pipe 17 flowing through both shut-off valve 38 and control valve 40. Shut-off valve 38 and control valve 40 are diaphragm and pinch valves, respectively. Maintenance is performed on elements downstream of valve 38 (e.g., control valve 40 and nozzle 18) by closing shut-off valve 38. Control valve 40 is opened or closed to permit or prevent media flow. Preferably, control valves 34 and 40 operate in unison to permit or restrict air flow and media flow substantially simultaneously.

After leaving control valve 40, media 22 passes through flow orifice 42 to mixing junction 36. Because media pot 14 is pressurized through media pressure pipe 29, the air pressure within media tube 17 is substantially the same as the air pressure within pipe 16. Consequently, the pressurized air within pipe 16 does not force media 22 through tube 17 back into media tank 14. Media 22 is free to fall through tube 17 into the airstream conveyed in piping 16 to be carried by the airstream.

The airstream flowing within pipe 16 must accelerate media 22 dropping into piping 16 at mixing junction 36, so that the rate of flow of the airstream is somewhat reduced by each particle so accelerated. Therefore, the air flow rate through piping 16 is at least partially dependent upon the quantity of media 22 introduced at junction 36. If a relatively large amount of media 22 is introduced, the rate of flow of the airstream through piping 16 is relatively low; similarly, if the amount of media 22 introduced at junction 36 is relatively small, the rate of flow of the airstream through piping 16 is relatively large.

The compressed airstream containing blasting media 22 is then conveyed through pipe 16*a*, coupling 44, and hose 46 to nozzle 18. Coupling 44 is a standard coupling which interconnects pipe 16*a* and hose 46.

Figure 2:
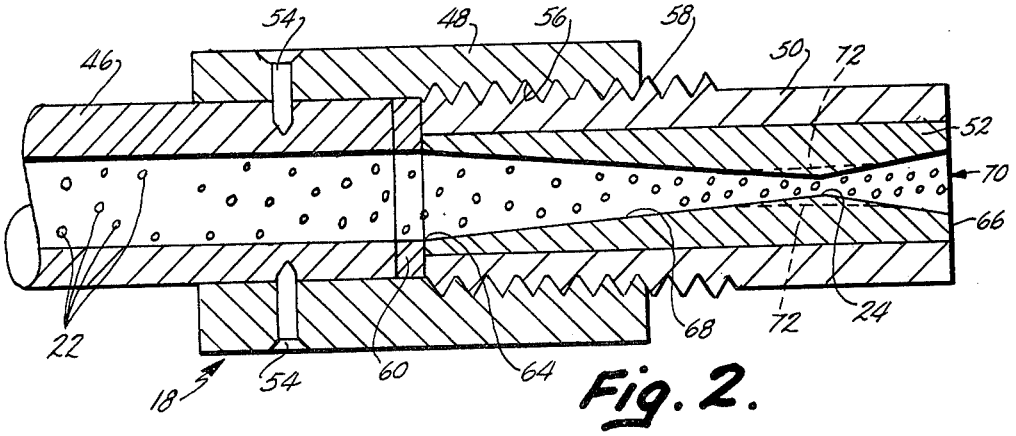
FIG. 2 is a sectional view of the nozzle.
Figure 3:
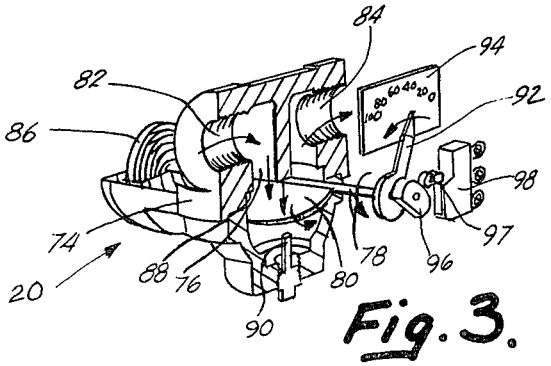
FIG. 3 is a perspective, sectional view of the air flow meter.

As best seen in FIG. 2, nozzle 18 generally includes coupling 48 fastened to hose 46, housing 50 threadedly secured within coupling 48, and sleeve 52 positioned within housing 50. A plurality of screws 54 extend through coupling 48 and into hose 46 to secure the coupling thereto. A portion 56 of the interior diameter of coupling 48 is threaded to receive externally threaded portion 58 of housing 50. Resilient washer 60 abuts both hose 46 and housing 50 to insure an airtight seal therebetween. By tightening housing 50 within coupling 48, washer 60 is compressed between hose 46 and housing 50.

Positioned within housing 50 is wear-resistant sleeve 52, which is preferably fabricated of boron carbide or tungsten carbide to withstand the constant bombardment of media 22 flowing therethrough. A first end 64 of sleeve 52 engages washer 60, and the opposite end 66 of sleeve 52 faces the article to be blasted. Inner wall 68 of sleeve 52 tapers inwardly from first end 64 to a restricted opening 24 and then flares outwardly from restricted opening 24 to opposite end 66. As the airstream carrying media particles 22 passes through sleeve 52, the particles are focused or directed as they pass through restricted opening 24. As media 22 passes beyond restricted opening 24, it travels in a shot stream 70 wherein the individual media particles travel in substantially parallel paths.

As media 22 passes through sleeve 52, the particles wear away a portion of inner wall 68 proximate restricted opening 24, as indicated by lines 72. As opening 24 is so enlarged, the amount or degree of focusing performed by nozzle 18 is greatly reduced. When opening 24 is excessively enlarged, it is desirable to replace sleeve 52 with one having a properly dimensioned restricted opening 24.

The rate of flow of the airstream through pipe 16 is also affected by the effective size of restricted opening 24. That is to say, that when opening 24 is enlarged through wear to the size shown by lines 72, more air may pass through enlarged opening 24, and the air flow rate through pipe 16 will be relatively high.

Occasionally, an accumulation of media 22 will collect at opening 24 blocking flow through nozzle 18. When such a blockage occurs, the air flow rate through piping 16 is virtually zero. Consequently, when the air flow in pipe 16 stops, some portion of pipe 16 or nozzle 18 has become blocked.

Noting the relationship between the air flow in pipe 16 and media flow, nozzle wear, and nozzle blockage, air flow meter 20 is installed in piping 16 to monitor the rate of flow of the airstream through piping 16. Although meter 20 is well known to one skilled in the art, such a meter has not previously been used in conjunction with particle blasting equipment. Basically, meter 20 comprises a housing 74 defining an air passageway or chamber 76, a vane shaft 78 rotatably mounted within chamber 76, and vane 80 fixedly mounted on shaft 78.

Housing 74 further defines internally threaded inlet 82 and internally threaded outlet 84 communicating with chamber 76. When positioned in piping 16, air flowing out of control valve 34 passes into meter 20 through inlet 82 and out through outlet 84. Coil spring 86 has one end fixedly mounted to housing 76 and its other end fixedly mounted to shaft 78 to bias vane 80 into engagement with stop 88 defined by housing 74. When air flows through chamber 76 as described, vane 80 is deflected rotating shaft 78. The deflection of vane 80 is generally proportional to the rate of flow through meter 20. Stop 90 is positioned within housing 74 to prevent vane 80 from rotating beyond a maximum position.

Pointer 92 is fixedly mounted on shaft 78 for rotation therewith. Scale 94 is positioned behind pointer 92 to provide a means of reading the relative movement of the pointer. When vane 80 is undeflected (i.e., when no air is flowing through meter 20), pointer 92 points to a 0 on scale 94. However, as air flows through meter 20, vane 80 is deflected in proportion to the rate of flow of the airstream, and accordingly pointer 92 is deflected toward a number on scale 94 generally proportional to the rate of flow through meter 20.

Cam 96 is also fixedly mounted on shaft 78 for rotation therewith to operate switch 98. Cam follower 97 extending from switch 98 engages the outer, or cam, surface of cam 96 in a conventional manner. Cam 96 is oriented on shaft 78 so that when the rate of flow of air through the meter is less than a predetermined minimum parameter switch 98 through line 100*a* turns light 102 on, indicating that the air flow rate is too low. Likewise, when the air flow rate through meter 20 is greater than a predetermined maximum parameter, switch 98 through line 100*b* turns light 104 on. Alternatively, line 100*c* may be electrically connected to switch 98, control valves 34 and 40, and wire drawer 106 to automatically close those valves and shut down the wire drawer should the rate of flow be greater than the predetermined maximum parameter or less than the predetermined minimum parameter.

Operation

To operate device 10, media 22 is first introduced into pot 14. Compressed air supply 12 is then actuated and pressure regulator 28 is adjusted to provide a desired air pressure, which in the preferred embodiment is approximately 80 psi. Shut-off valves 32 and 38 are opened to their fully open position so that air and media may pass respectively therethrough. Valves 34 and 40 are opened and closed generally in unison as a particle blasting stream is desired or undesired at nozzle 18. FIG. 1 shows nozzle 18 arranged to direct blasting media 22 onto wire 108 drawn by wire drawer 106. Alternatively, blasting device 10 could be used in conjunction with other equipment associated with the device, for example cold headers and presses.

The compressed air produced by supply 12 flows through piping 16, valves 32 and 34, and flow meter 20 to nozzle 18. Compressed air also flows from regulator 28 through media pressure pipe 29 to pot 14 to pressurize the pot. When valve 40 is opened, media falls through media pipe 17, valves 38 and 40, and flow orifice 42 to mixing junction 36. At junction 36, media 22 is introduced into the airstream conveyed within pipe 16 to be carried by the airstream through coupling 44 to nozzle 18. The amount of media introduced into pipe 16 is regulated by flow orifice 42. The airstream carrying the media particles passes through nozzle 18 and more particularly, restricted opening 24 to focus or direct the media onto the article to be blasted.

In a preferred embodiment of the invention, and by way of illustration only, approximately 10 to 20 pounds per minute of media is introduced into the airstream at junction 36. With an air pressure of approximately 80 psi within piping 16, approximately 100 to 150 cfm of air will pass through pipe 16 to nozzle 18. Cam 96 on vane shaft 78 is selected and mounted so as to actuate switch 98 to illuminate light 102 below a reading of 100 cfm and to illuminate light 104 above a reading of 150 cfm. Optionally, switch 98 through line 100*c* may cause control valves 34 and 40 to close and wire drawer 106 to shut down when the air flow rate is outside of the acceptable range.

As long as the proper amount of media is introduced into the airstream, and nozzle 18 is not blocked or excessively worn, the rate of flow through pipe 16 will remain in the 100 to 150 cfm range and neither of indicator lights 102 and 104 will be illuminated. However, if nozzle 18, and more particularly restricted opening 24, becomes blocked with an accumulation of media 22, the rate of flow of air through pipe 16 will drop significantly below 100 cfm. Likewise, if an excessive amount of media 22 is introduced at junction 36, the rate of flow of air through pipe 16 will also drop below 100 cfm because the air flow is reduced as the air must accelerate an excessive amount of media. In either event, cam 96 on vane 78 will be rotated so as to cause switch 98 through line 100*a* to illuminate light 102 indicating that a problem exists. Optionally, switch 98 may cause valves 34 and 40 to close, preventing further blasting, and wire drawer 106 to shut down. The operator must then take corrective action to either unblock nozzle 18 or adjust flow orifice 42 so that the proper amount of media 22 is introduced into the airstream.

If restricted opening 24 is excessively enlarged or worn, for example as indicated by lines 72, the rate of air flow through pipe 16 will rise above 150 cfm. Similarly, if an insufficient amount of media 22 is introduced at junction 36, the rate of air flow through pipe 16 will also exceed 150 cfm because the air need not accelerate the proper amount of media. In either event, cam 96 on shaft 78 will be rotated so as to cause switch 98 through line 100*b* to illuminate light 104 indicating that a problem exists. Optionally, switch 98 may cause valves 34 and 40 to close and wire drawer 106 to shut down. The operator must then take corrective action to either adjust flow orifice 42 so that the proper amount of media 22 is introduced at junction 36 or replace sleeve 52 with one having a properly dimensioned opening 24. After taking the proper corrective action, device 10 is once again actuated to particle blast an object.

The particle blasting apparatus of the present invention enables both media flow and nozzle wear and blockage to be easily, readily, and continuously monitored. Because the rate of flow of the airstream through device 10 is dependent primarily upon both the rate of flow of media 22 and the effective size of restricted opening 24, both the media flow and nozzle condition can be monitored by monitoring the air flow rate. If the rate of flow is greater than the predetermined maximum parameter or is less than a predetermined minimum parameter device 10 either illuminates an indicator light or shuts itself, or associated equipment, down so that corrective action may be taken.

It should be understood that the above description is intended to be that of a preferred embodiment of the invention. Various changes and alterations might be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. An improved particle blasting apparatus for monitoring media flow, nozzle wear, and nozzle blockage, said equipment having a source of compressed air, a nozzle defining a restricted opening, means conveying said compressed air from said source to said nozzle in an airstream, and means operatively connected to said air conveying means introducing particle blasting media into said airstream, whereby said media is carried through said nozzle by said airstream, wherein the flow rate of said airstream through said air conveying means is affected both by the amount of said media introduced into said airstream and by the effective size of said restricted opening in said nozzle, wherein the improvement comprises air flow metering means operatively connected to said air conveying means indicating said flow rate through said air conveying means, whereby insufficient media introduction and an excessive size of said restricted opening increases said flow rate causing said metering means to indicate an excessive flow rate greater than a predetermined maximum parameter, and whereby excessive media introduction and blockage of said nozzle reduces said flow rate causing said metering means to indicate an insufficient flow rate less than a predetermined minimum parameter.

2. An apparatus as defined in claim 1 further comprising means regulating the pressure of said compressed air, whereby said compressed air in said air conveying means has a generally constant pressure.

3. An apparatus as defined in claim 2 further comprising means pressurizing said media introducing means whereby said media is introduced under a pressure into said air conveying means.

4. An apparatus as defined in claim 3 wherein said pressurizing means comprises means equalizing said pressure in said air conveying means and said pressure in said media introducing means.

5. An apparatus as defined in claim 1 further comprising means pressurizing said media introducing means whereby said media is introduced under a pressure into said air conveying means.

6. An apparatus as defined in claim 1, 2, or 5 further comprising:

first means illuminating a first indicator light whenever said flow rate is greater than said maximum parameter; and second means illuminating a second indicator light whenever said flow rate is less than said minimum parameter.

7. An apparatus as defined in claim 1, 2, or 5 further comprising means responsive to said air flow metering means for interrupting at least one of said airstream, said media introducing means, and other equipment associated with said apparatus whenever said flow rate is greater than said maximum parameter or less than said minimum parameter.

8. An apparatus as defined in claim 1, 2, or 5 wherein said metering means comprises:

a housing defining a chamber and an inlet and outlet communicating with said chamber;

a shaft rotatably mounted within said housing;

a vane fixedly mounted on said shaft and positioned within said chamber;

means biasing said vane into a first position, whereby when no air is flowing through said chamber, said vane is in said first position, and when said air is flowing through said chamber, said air deflects said vane thereby rotating said shaft generating proportionally to said flow rate; and means fixedly mounted on said shaft indicating the angular orientation of said shaft.

9. A particle blasting apparatus comprising:

a source of compressed air;

means conveying said compressed air in an airstream from said source;

a source of particle blasting media;

means introducing said blasting media into said air conveying means to be carried by said airstream;

a nozzle operably connected to said air conveying means for directing said airstream carrying said blasting media against an article to be particle blasted, said nozzle defining a restricted opening; and an air flow rate meter operatively connected to said air conveying means between said compressed air source and said media source to indicate the flow rate of said air moving through said air conveying means, whereby said meter indicates an excessive rate flow greater than a predetermined maximum parameter when insufficient media is introduced into said airstream and when the size of said opening exceeds a predetermined maximum size, and whereby said meter indicates a reduced flow rate less than a predetermined minimum parameter when excessive media is introduced into said airstream and when said nozzle is blocked with said media.

10. An apparatus as defined in claim 9 wherein said air conveying means further comprises means regulating the pressure of said compressed air so that said air in said air conveying means has a generally constant pressure.

11. An apparatus as defined in claim 10 further comprising means pressurizing said media source to facilitate media movement through said media introducing means.

12. An apparatus as defined in claim 11 wherein said pressurizing means comprises means equalizing the pressure of said compressed air in said air conveying means and the pressure in said media source.

13. An apparatus as defined in claim 9 further comprising means pressurizing said media source to facilitate media movement through said media introducing means.

14. An apparatus as defined in claim 9, 10, or 13 further comprising:

first means illuminating a first indicator light whenever said flow rate is greater than said maximum parameter; and second means illuminating a second indicator light whenever said flow rate is less than said minimum parameter.

15. An apparatus as defined in claim 9, 10, or 13 further comprising means responsive to said air flow rate meter for interrupting at least one of said airstream, said media introducing means, and other equipment associated with said apparatus whenever said flow rate is greater than said maximum parameter or less than said minimum parameter.

16. An apparatus as defined in claim 9, 10, or 13 wherein said metering means comprises:

a housing defining a chamber and an inlet and outlet communicating with said chamber;

a shaft rotatably mounted within said housing;

a vane fixedly mounted on said shaft and positioned within said chamber;

means biasing said vane into a first position, whereby when no air is flowing through said chamber, said vane is in said first position, and when said air is flowing through said chamber, said air deflects said vane thereby rotating said shaft generally proportionally to said flow rate; and means fixedly mounted on said shaft indicating the angular orientation of said shaft.

17. A method for monitoring media flow, nozzle wear, and nozzle blockage in particle blasting equipment having a source of compressed air, a nozzle defining a restricted opening, means conveying said compressed air in an airstream from said source to said nozzle, and means introducing particle blasting media into said airstream to be carried by said airstream through said nozzle, said method comprising the steps of:

establishing a maximum flow rate of said airstream indicating that insufficient media is being introduced into said airstream or that said restricted opening in said nozzle is excessively large;

establishing a minimum flow rate of said airstream indicating that excessive media is being introduced into said airsteam or that said nozzle is blocked; and monitoring the flow rate of said airstream to determine when said flow rate is greater than said maximum flow rate or less than said minimum flow rate indicating that corrective action is necessary.

18. A method as defined in claim 17 further comprising the steps of:

illuminating a first indicator light whenever said flow rate is greater than said predetermined maximum flow rate; and illuminating a second indicator light whenever said flow rate is less than said predetermined minimum flow rate.

19. A method as defined in claim 17 further comprising the step of interrupting at least one of said airstream, said media introducing means, and other equipment associated with said apparatus whenever said flow rate is greater than said predetermined maximum flow rate or less than said predetermined minimum flow rate.

20. A method as defined in claim 17 wherein said monitoring step comprises:

providing an air flow rate meter operably connected to said air conveying means; and monitoring said meter to determine when said flow rate is greater than said predetermined maximum flow rate or less than said predetermined minimum flow rate.

21. In a particle blasting system having a source of compressed air, a supply of particles, a nozzle, and means for forcing said particles through said nozzle by means of said compressed air, the improvement comprising:

air flow metering means operatively connected in said system for monitoring the flow rate of said compressed air forcing said particles through said nozzle.

22. The system of claim 21 in which means is operatively connected to said flow metering means to indicate excessive and insufficient quantities of particles being forced through said nozzle.

23. The system of claim 21 in which shut-off means is provided for interrupting at least one of said compressed air, said supply of particles, and other equipment associated with said system; and in which means is operatively connected to said flow metering means for actuating said shut-off means in response to air flow rate above or below a predetermined air flow rate range.

24. The method of claim 20 wherein said providing step comprises providing said air flow rate meter between said compressed air source and said media introducing means.

* * * * *

UNITED STATES PATENT AND TRADEMARK OFFICE

CERTIFICATE OF CORRECTION

PATENT NO. : 4,420,957

DATED : December 20, 1983

INVENTOR(S) : Joseph H. Weber

It is certified that error appears in the above—identified patent and that said Letters Patent is hereby corrected as shown below:

Column 7, Claim 8, line 67:
"generating" should be --generally--.

Signed and Sealed this

*Twenty-ninth* Day of *May 1984*

[SEAL]

*Attest:*

GERALD J. MOSSINGHOFF

*Attesting Officer*

*Commissioner of Patents and Trademarks*